US005784806A

United States Patent [19]

Wendt

[11] Patent Number: 5,784,806

[45] Date of Patent: Jul. 28, 1998

[54] FLEXIBLE FOOT GEAR

[76] Inventor: Lydia Wendt, 334 W. 47th St., Apt. 2C, New York, N.Y. 10036

[21] Appl. No.: 697,138

[22] Filed: Aug. 20, 1996

[51] Int. Cl.[6] ..... A41D 17/00; A43B 11/00

[52] U.S. Cl. ..... 36/2 R; 36/51; 36/54

[58] Field of Search ..... 36/1.5, 2 R, 2 B, 36/51, 54, 45, 9 R

[56] References Cited

U.S. PATENT DOCUMENTS

| | | | |
|---|---|---|---|
| 1,250,940 | 12/1917 | Archambeau | 36/51 |
| 1,539,332 | 5/1925 | Smiley | 36/45 |
| 1,639,783 | 8/1927 | Norden et al. | 36/2 R |
| 1,737,795 | 12/1929 | Hodges | 36/2 R |
| 2,197,102 | 4/1940 | Edwards | 36/45 |
| 2,230,291 | 2/1941 | Evans | 36/1.5 |
| 2,334,659 | 11/1943 | Van Arsdale et al. | 36/9 R |
| 3,035,291 | 5/1962 | Bingham, Jr. | 36/9 R |
| 3,931,685 | 1/1976 | Laukaitis | 36/51 |
| 4,586,271 | 5/1986 | Maleyko et al. | 36/2 R |
| 4,785,558 | 11/1988 | Shiomura | 36/45 |
| 5,413,846 | 5/1995 | Besana | 428/229 |

*Primary Examiner*—M. D. Patterson

*Attorney, Agent, or Firm*—Mitchell A. Stein; Stein & Associates, P.C.

[57] ABSTRACT

A comfortable and breathable foot gear in the form of a sneaker/boot comprises a flexible sole constituting a lower portion of said garment, and a stretch fabric material constituting an upper portion of the foot garment that is securely attached to the flexible sole. The stretch fabric material is a weave of spun yarn material and an elastomeric material adapted to form fit about a foot placed within foot gear and capable of being stretched to form fit about the wearer's calf.

30 Claims, 4 Drawing Sheets

FLEXIBLE FOOT GEAR

FIELD OF THE INVENTION

The present invention relates to the field of foot wear, and more particularly to foot gear that is stretchably-fitted, wickable and breathable imparting both functional comfort and aesthetic appeal to the wearer by securely mounting an upper, weft-stretch woven fabric having a blend of cotton and spandex to a flexible sole lower portion.

BACKGROUND OF THE INVENTION

In the field of footwear, a number of materials have been employed to create advantages for sports (e.g., sneakers having light-weight materials), aesthetics (e.g., flashing lights), and function (e.g., steel for boots). It has always been a goal in the industry to battle these objectives while creating a product that is, at the same, commercially feasible.

The art is replete with combined functional and design themes. For example, U.S. Pat. No. 5,070,630 to Edmundson shows a decorative cast cover seeking to transform a typically functional, rigid cast for broken limbs into a shoe and sock-appearing design; U.S. Pat. No. 347,442 to Rauh shows a combined shoe and stocking; U.S. Pat. No. 3,304,629 to Meyers shows simulated costume or theatrical footwear for use with conventional shoes; Norwegian Patent No. 70430 shows a sock design; U.S. Pat. No. 4,064,641 to Levine shows footwear with detachable portions; U.S. Pat. No. 1,642,050 to Wharton shows a foldable waterproof boot; U.S. Pat. No. 2,795,865 to Backiel shows a protective foot covering for protecting hose prior to putting on a shoe; U.S. Pat. No. 3,816,944 to Jester shows an ankle support device for basketball players; U.S. Pat. No. 2,343,477 to Ross shows a boot sock; U.S. Pat. No. 2,340,578 to Cairns shows a laced shoe with an overlay for athletic use; U.S. Pat. No. 2,159,816 to Murphy shows a riding boot fitted to the wearer by use of a zipper; U.S. Pat. No. 1,095,834 to Ferguson shows a flexible dress overshoe; U.S. Pat. No. 1,189,665 to Clear & Richville shows a child's boot; U.S. Pat. No. 1,476,826 to Martin shows an overboot; Swiss Patent No. 16,009 to Blatt shows a knit upperlegging; U.S. Pat. No. 1,715,147 to Porr shows footwear; U.S. Pat. No. 5,249,375 to Tabarly shows a boot for sailing or for winter sports; U.S. Pat. No. 4,856,207 to Datson shows a shoe and gaiter; Swiss Patent No. 24,546 to Blatt shows a leather and knit shoe; U.S. Pat. No. 4,896,438 to DeBease shows a water-resistant boot for athletic footwear; EP 0,066,133 to Perotto shows an inner boot structure particularly for ski boots with an insole having ankle pad support; U.S. Pat. No. 4,586,271 to Maleyko, et al. shows an extendible boot; U.S. Pat. No. 4,064,642 to Vykukal, et al. shows a walking boot assembly; U.S. Pat. No. 2,147,197 to Glidden shows an article of footwear with a textile upper; U.S. Pat. No. 1,854,969 to Walsh shows a combined legging, stocking and shoe protector; U.S. Pat. No. 1,901,492 to Berry shows a combined rubber and legging; U.S. Pat. No. 1,717,790 to L'Hollier, et al. shows a slide fastener overshoe; and U.S. Pat. No. 255,438 to Linscott shows shoe reinforcements.

However, the art does not show, and indeed, the industry requires, foot gear designed to tightly embrace the ankle and possible calve and leg of the wearer with a material that possesses stretchability, wickability, breathability and comfort, while at the same time being conformable to various levels on the calf, simultaneously attached to a rubber or flexible sole portion, which may also entirely replace the use of socks in conjunction with flexible soled foot gear.

Accordingly, it is an object of the present invention to provide a flexible foot gear that comprises a flexible sole and a weft-stretch woven fabric upper portion capable of being form-fitted about feet, arches and the ankle, of varying shapes and sizes.

A more specific object of the present invention is to provide a flexible boot that comprises a comfort stretch woven fabric material comprising a woven blend of cotton material (yarn or fiber) and Lycra®/Spandex (plain weave) that is capable of being stretched to form-fit around the lower leg and foot of the wearer.

Another object of the present invention is to provide a flexible foot gear that comprises a weft-stretch woven fabric material that is breathable and wicks perspiration away from the wearer.

A further object of the invention is to provide a flexible foot gear that comprises a weft-stretch woven fabric material that is lightweight, washable, may be printed upon to promote a decorative appearance and may be worn in a strictly casual, fashionable sense.

Yet another object of the present invention is to provide a flexible boot that comprises a woven weft-stretch fabric material that is flexible, lightweight, and durable enough to be worn while engaging in leisure and sports activities such as hiking, golf, biking, etc., thus, obviating the need to wear heavy woven fabric sneakers in conjunction with socks.

A further object of the present invention is to provide a flexible foot gear that comprises an upper body portion formed of a weft-stretch woven fabric material having a first decorative outer appearance and that comprises an inner lining having a second decorative appearance, such that the upper body portion may be folded to expose a portion of the inner lining to create a complementing appearance comprising the first and second decorative patterns.

Still another object of the invention is to provide a flexible foot gear that comprises a minimum of seams, and optional removal of the tongue, without requiring the use of laces.

Yet still another object of the present invention is to provide a flexible foot gear that comprises a weft-stretch woven fabric material that includes an adjustable top portion to further form fit about a wearer's lower leg and foot.

A still further object of the invention is to provide a flexible foot gear that comprises a woven weft-stretch fabric material having an inverted pleat formed in a top of the gear to facilitate insertion of a foot and ankle portion within the gear.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

In order to accomplish the foregoing, there is provided a foot garment comprising:

(a) a flexible sole constituting a lower portion of said garment; and (b) a durable, weft stretch, woven, fabric material constituting an upper portion of said garment and securely attached to said flexible sole, said stretch fabric material including a weave of spun yarn material and an elastomeric material adapted to form fit about a foot placed within said garment and capable of being stretched to form fit about a portion of a leg, said upper portion of said stretch fabric material enabling sufficient air circulation for both the foot and leg of a wearer.

BRIEF DESCRIPTION OF THE DRAWINGS

Reference may now be had to a preferred embodiment of the foot gear of the invention, taken in conjunction with the accompanying drawings, in which.

DETAILED DESCRIPTION OF THE PREFERRED EMBODIMENTS

Figure 1:
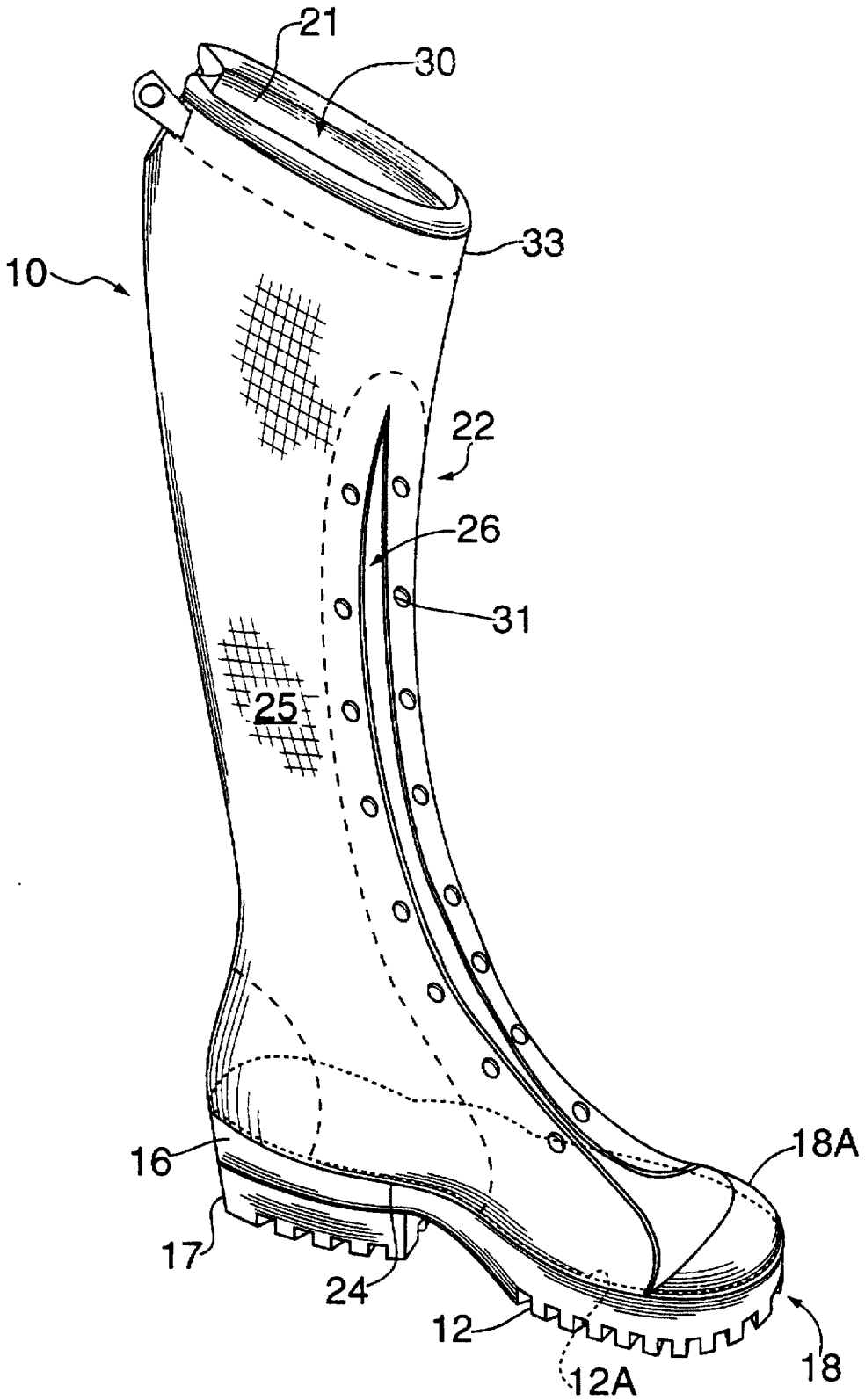
FIG. 1 is a perspective view of a preferred embodiment of the foot gear of the invention.

Referring now in more specific particularity to the drawings, as shown in FIG. 1, there is illustrated a perspective view of the foot gear 10 of the invention.

Figure 7A:
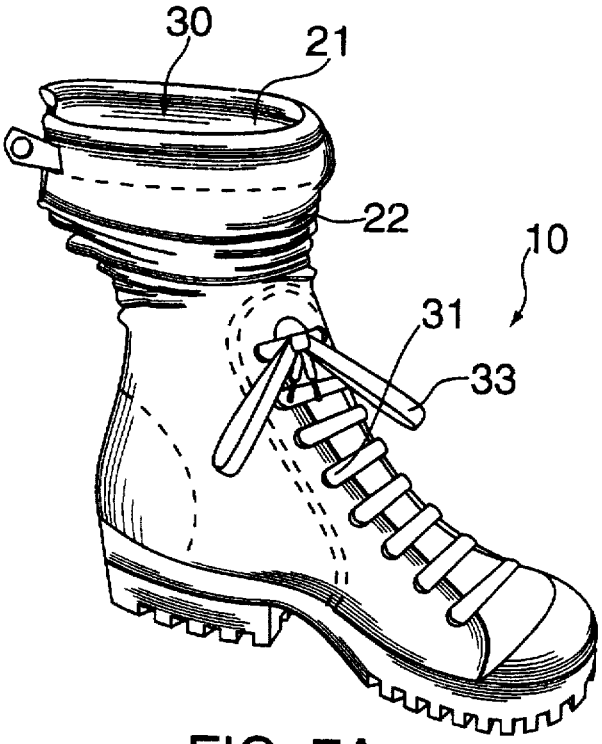
FIGS. 7A and 7B are perspective views of an additional embodiment of the instant invention showing a laced design.
Figure 7B:
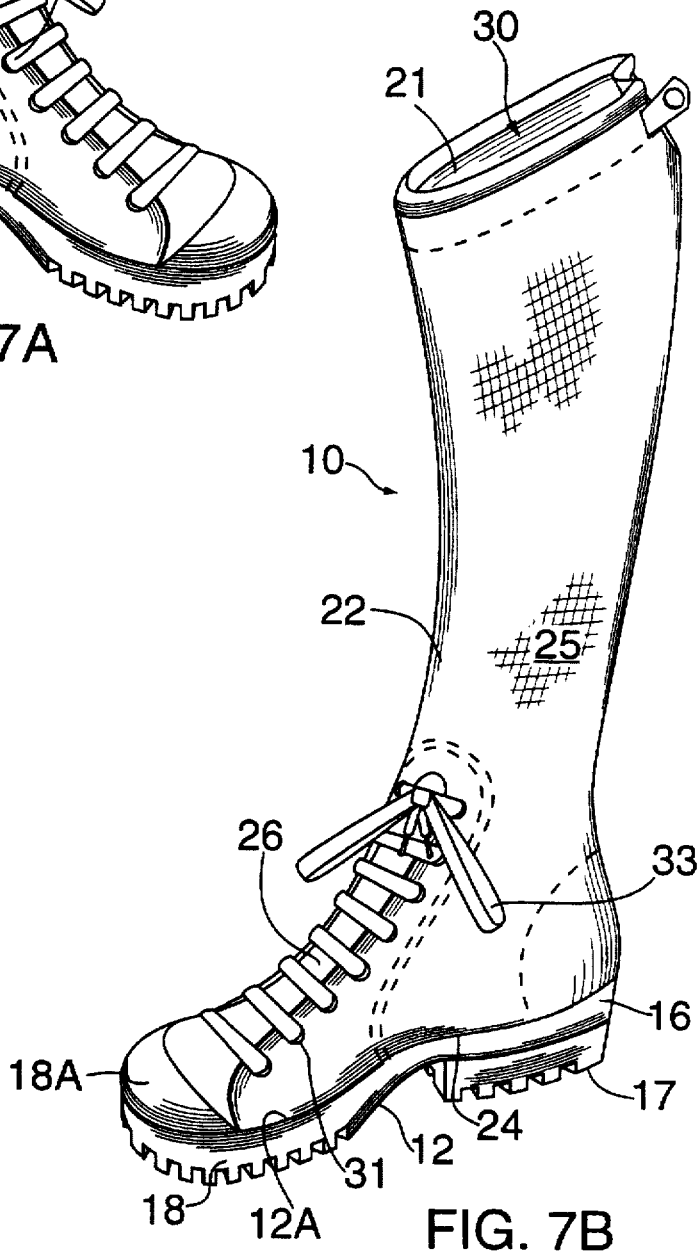

As shown, the foot gear 10 is in the shape of a boot that consists of a bottom sole 12 having a heel 16 and toe portion 18, and an upper body portion 22 formed of a plain weave, weft-stretch fabric 25. As shown in FIGS. 1, 7A and 7B, the upper body portion 22 has an opening 30 and is capable of being stretched to form fit around a foot and calf of a person wearing the foot gear. However, as seen in FIG. 7A, the upper body portion 22 may also be scrunched down to cover the ankle in a more loosely fitted manner while additionally retaining the form fit about the wearer's foot by virtue of the nature of fabric 25, therefore keeping the foot garment 10 about the foot and maintaining the function of the gear. The upper body portion 22 is preferably sewn to the bottom sole 12 about the periphery 24 thereof by known manufacturing techniques or, may be both sewn and glued to the bottom sole at the periphery 24 for reinforced attachment.

Figure 2:
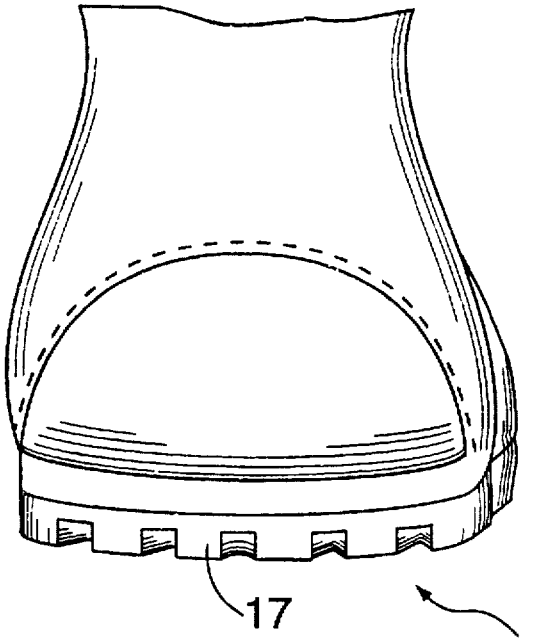
FIG. 2 is a rear view perspective of the heal and seam application.
Figure 3:
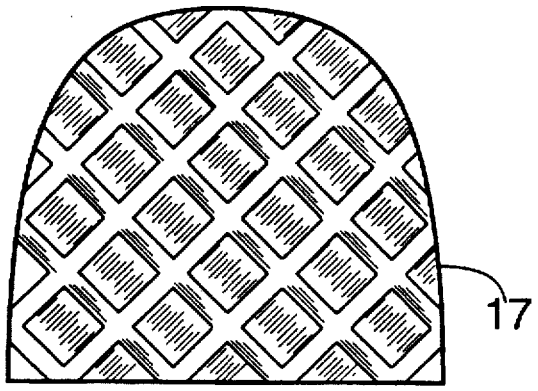
FIG. 3 is an upwardly-directed bottom view of the heal.

In the preferred embodiment, as shown in, for example, FIGS. 2 and 3, the bottom sole 12 is a one-piece molded rubber or other molded synthetic material sole that is flexible, lightweight and shock-absorbing. The sole 12 may be injection molded for its formation, and may be formed by direct injection molding onto the material. The sole 12 may be flat (not shown) or contain a heel portion 16 and may be formed with a bottom tread 17 (see FIG. 3) for better gripping action to be worn while engaging in leisure or sports activities. As shown in FIGS. 1, 7A and 7B, the toe 18 of the sole 12 may include an upper toe portion **18*a*** for increased stability and protection.

As indicated by the broken lines in FIG. 1, the foot garment may include an insole **12*a*** having an arch cushion to provide for more foot arch support and foot aeration, and, preferably, may be removable.

The flexible foot gear as shown in FIGS. 1, 7A and 7B, may additionally include a sewn in tongue portion 26 made of the same woven weft-stretch fabric 25 to ease the entry of a foot into the foot gear 10. In an embodiment, the tongue 26 is completely sewn into the top portion of the upper body portion 22 and is made of the same woven weft-fabric and shaped similar to a tongue. In this embodiment, such a sewn-in pleat-like tongue 26 is inverted and provides the boot with additional room for the wearer to insert his/her foot and pull up on the boot and to accommodate for feet and foot arches of varying sizes and shapes. More importantly, the substitution of an inverted pleat-like tongue reduces the bulk associated with a typical tongue, and additionally reduces the possibility of abrasion from slippage and movement of tongue, associated with seams with tongues constructed in a conventional shoe or sneaker. Moreover, the inverted pleat-like tongue 26 provides the appearance of an underlay.

As shown in FIGS. 1, 7A and 7B, the foot gear 10 may be provided with grommets 31 for receiving laces 33 that will function to lace the tongue 26 together in varying degrees in order to achieve a desired appearance and in order to provide tighter fit about ankle. For instance, lacing of the tongue 26 completely closed will give the wearer the appearance of a sleek form fitting legging that is tight to the ankle of the wearer. Thus, it is not the case that the laces or zipper functions to keep a shoe on a foot as in a conventional shoe or boot. Contrarily, the flexible foot gear 10 is intended to stay on a foot due to the elasticity and sturdy, durable weave of the woven, weft-stretch fabric 25 of the upper body portion 22, as described herein. It is understood that the combination of grommets 31 and lace 33 may be replaced with a zipper (not shown) or any similar functioning means. However, whether laces are used or not, the flexible foot gear will stay on the foot. If the wearer chooses not to lace, a "slouched" sock appearance as shown in FIG. 7A will result when the upper portion 22 is pushed down off the calf. Additionally, as shown in FIG. 7A, a variation of appearance is achievable when the upper portion 22 of the boot is rolled down loose to the ankle to expose a contrasting fabric lining. This contrasting fabric lining, also called a second complementing decorative pattern, is intended to perform like the outer fabric, and is thus comprised of the same material, including cotton and LYCRA/spandex.

As briefly mentioned above, in a preferred embodiment, the upper body portion 22 of the foot gear 10 comprises a woven, weft-stretch fabric 25 comprising a core spun yarn having a central filament core of a stretch spandex (or elastomeric material) having a staple fiber which has been spun around the core. The core does not appear on the yarn surface, so the texture and appearance of the fabric are identical to spun yarn without such a core center. Such core spun yarn material thus can be spun in a very fine manner and provide elasticity without bulkiness. In the preferred embodiment, the woven weft-stretch fabric 25 is a woven blend of polyurethane segmented filaments such as Elastane, spandex, polyetherester, elastoester or esteleast, and preferably is Lycra® (product of E. I. Dupont de Nemours & Co.) with spun cotton fiber, wherein the percentage of Lycra® filament relative to the cotton fiber is sufficient to provide elasticity for the fabric 25 to form fit about the wearer's ankle and lower to upper calf. Moreover, the woven weft-stretch fabric 25 of cotton/Lycra® will form fit over a variety of foot, ankle and calf sizes to accommodate weight changes, monthly swelling (in women), rapid growth in youths, etc., without a decrease in comfort. Besides stretchability, the woven, weft-stretch fabric 25 of cotton/Lycra®/spandex provides other advantages such as wicking of body perspiration typically associated with cotton fiber material as a fabric. Furthermore, the durable weave is tight enough to provide protection from fleas, ticks, poison ivy, brush, bushes, etc., such that it can be worn for leisure/sports activities such as back-woods hiking, walking, biking, and the like.

Likewise, the material is preferably woven with a stretch only in the weft. In keeping the warp stable, the material thereby possesses longer wear, is easier to sew/construct, and is more durable, while providing the needed elasticity via the weft, without forfeiture of such durability in wear, wash and tear. In comparison, when a circular and/or flat knit is used, in, for example, the prior art, such knitting construction comprises loops which do not provide such strength, support and durability. The non-stretch yarn and fibers of the subject invention are selected from the group consisting of cotton, wool, polyester, nylon, acetate, rayon and combinations thereof.

In accordance with a preferred embodiment of the subject invention, the elastomeric yarn component is between 2% and 9%, preferably 4–6%, counted by weight, of the weft-stretch yarn.

The woven, weft-stretch fabric 25 may additionally be printed with various decorative color patterns, sports teams logos, etc. for increased fashionability and can be combined with an exposed inner lining, to provide a more varied complementing decorative appearance.

As shown in FIGS. 1, 7A and 7B, the inner surface 21 of the woven, weft-stretch fabric material 25 of the flexible foot gear upper portion 22 may be brushed or napped back to emulate a double-faced fabric with the inner surface 21 being softer than the outer surface. Or, in such an advantageous embodiment, the flexible foot gear 10 may be lined with a terry cloth looped face fabric comprising a cotton/polyester/Lycra® blend or cotton/Lycra® blend or a polar fleece/Lycra® blend. The content of the polar fleece will be primarily polyester. However, any inner fabric combined with the outer fabric will have a similar percentage of Lycra® so that it may stretch at the same rate as the outer upper body portion 22 of the foot gear 10.

As stated before, FIG. 2 shows heel portion 16 and bottom tread 17, showing a configuration having a half-moon seam for shape and stability around the heel of the wearer. FIG. 3 shows the tread 17, upwardly directed.

Figure 4:
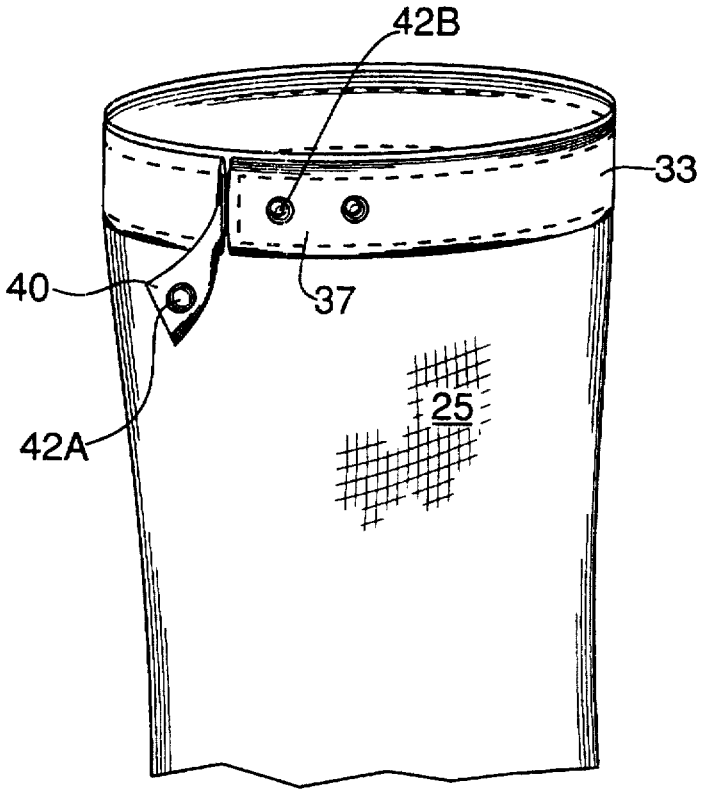
FIG. 4 is a perspective view of an adjustment mechanism for the top of the leggings portion of a preferred embodiment of the invention.
Figure 5:
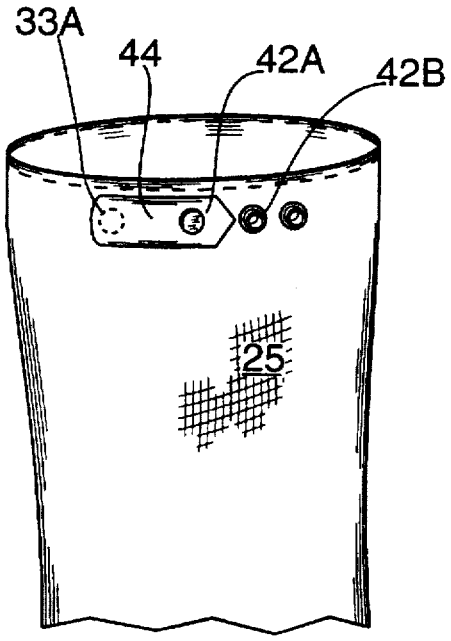
FIG. 5 is a perspective view of a variation of the adjustment mechanism shown in FIG. 4.
Figure 6:
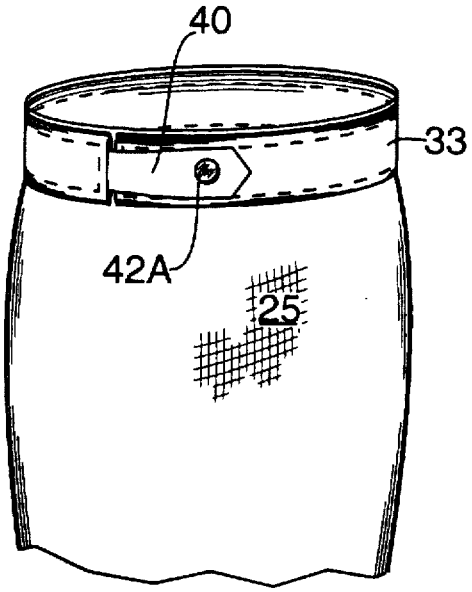
FIG. 6 is a perspective view, fully cinched, of the adjustment mechanism shown in FIG. 4.

FIGS. 4, 5 and 6 show woven, weft-stretch fabric 25 comprising an upper portion of foot gear 10 wherein a cinching mechanism 33 is provided to better aid in tightening the upper portion of the gear about the wearer's upper calf. In the advantageous embodiment shown in FIGS. 4 and 6, the cinching mechanism comprises a tunneled tab 40 having a snap 42A which engages comformingly shaped snap engaging portions 42B. A number of such portions 42B can be provided in spaced relationship such that varying tightness can be had. FIG. 6 shows the embodiment of FIG. 4, fully cinched.

FIG. 5 shows an alternative engagement cinching mechanism 33A having a top appliqued tab 44 which, like the embodiment shown in FIGS. 4 and 6, possesses snap 42A which engage with portions 42B.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

I claim:

1. A foot gear comprising:

(a) a flexible sole at a lower portion thereof having a forward, toe region;

(b) an upper portion securely attached to said flexible sole adapted to conform with the ankle of a wearer and extend thereabove;

(c) a tongue portion securely attached to said flexible sole at said toe region and extending upwardly therefrom in a manner such that said tongue portion provides ease of entry of a foot of the wearer and adjustment for conformation of the foot gear to the foot and ankle of the wearer; and (d) wherein said upper portion and said tongue portion are comprised of a stretchable, weave fabric consisting essentially of a combination of a substantially non-stretch yarn woven with a weft-stretch elastomeric yarn, wherein said fabric and said portions are adapted to snugly conform to at least the foot and ankle of the wearer.

2. The foot gear according to claim 1, wherein said non-stretch yarn is selected from the group consisting of cotton, wool, polyester, nylon, acetate, rayon, and combinations thereof.

3. The foot gear according to claim 1, wherein said elastomeric yarn is selected from the group consisting of spandex, polyetherester, elastoester, and estelast.

4. The foot gear according to claim 1, wherein said elastomeric yarn is selected from the group consisting of LYCRA® and REXE®.

5. The foot gear according to claim 1, further including an inner lining consisting of a stretch fabric material having a stretch substantially equivalent to said fabric.

6. The foot gear according to claim 5, wherein said inner lining material consists of terry cloth.

7. The foot gear according to claim 6, wherein said inner lining material consists of stretchable napped fleece material.

8. The foot gear according to claim 7, wherein said stretchable napped fleece material includes a spandex.

9. The foot gear according to claim 5, wherein said upper portion includes an outer surface having a first decorative pattern formed thereon.

10. The foot gear according to claim 9, wherein said inner lining material includes a surface having a second decorative pattern formed thereon.

11. The foot gear according to claim 10, wherein said stretchable material upper portion is foldable about said wearer's calf to expose said second decorative pattern of said inner lining in overlying relationship with respect to said first decorative pattern thereby creating a complementing decorative appearance which comprises said first and second decorative patterns.

12. The foot gear according to claim 1, wherein said flexible sole is injection molded and of one piece construction.

13. The foot gear according to claim 1, wherein said upper portion is further adapted to conform about a wearer's calf of varying sizes.

14. The foot gear according to claim 1, wherein said tongue portion consists of an inverted pleat.

15. The foot gear according to claim 1, wherein a peripheral portion of said upper portion includes an elastic element to enable increased fitting about a wearer's calf, wherein said elastic element provides horizontal elasticity and adjustable cinching.

16. The foot gear according to claim 1, wherein said fabric upper portion comprises a wickable yarn in the weft to wick perspiration away from the wearer's foot and calf when worn.

17. The foot gear of claim 1, wherein said elastomeric yarn is between 2% and 9%, counted by weight.

18. A foot gear comprising:

(a) a flexible sole constituting a lower portion of said garment; and (b) a stretch fabric material constituting an upper portion of said gear and securely attached to said flexible sole, said stretch fabric material consisting essential of a weave of spun yarn material and an elastomeric material adapted to form fit about a foot placed within said gear and capable of being stretched to form fit about a portion of a leg, said upper portion of said stretch fabric material enabling sufficient air circulation for both the foot and leg of a wearer.

19. The foot gear according to claim 18, wherein said spun yarn material is cotton.

20. The foot gear according to claim 18, wherein said elastomeric material is LYCRA® version of spandex.

21. The foot gear according to claim 18, further including an inner lining material consisting of a stretch fabric material including cotton and LYCRA® version of spandex.

22. The foot gear according to claim 18, wherein said stretchable material upper portion includes an outer surface having a first decorative pattern formed thereon.

23. The foot gear according to claim 21, wherein said inner lining material includes a surface having a second decorative pattern formed thereon.

24. The foot gear according to claim 23, wherein said stretchable material upper portion is foldable about said wearer's calf to expose said second decorative pattern of said inner lining in overlying relationship with respect to said first decorative pattern thereby creating a complementing decorative appearance which comprises said first and second decorative patterns.

25. The foot gear according to claim 23, wherein said elastomeric yarn is between 2% and 9%, counted by weight.

26. The foot gear according to claim 18, wherein said elastomeric yarn is between 2% and 9%, counted by weight.

27. A foot gear comprising:

(a) a flexible sole constituting a lower portion of said garment;

(b) woven stretch fabric material constituting an upper portion of said gear and securely attached to said flexible sole, said woven stretch fabric material consisting essentially of a weave of cotton material and the LYCRA® version of spandex material adapted to form fit about a foot placed within said gear and capable of being stretched to form fit about a portion of a leg, said upper portion of blended stretch fabric material enabling sufficient air circulation for both the foot and leg of a wearer; and (c) an inner lining material consisting of a blended stretch fabric material including a blend of cotton and the LYCRA® version of spandex.

28. The foot gear according to claim 27, wherein said woven stretch fabric material upper portion includes an outer surface having a first decorative pattern formed thereon.

29. The foot gear according to claim 28, wherein said inner lining material includes a surface having a second decorative pattern formed thereon.

30. The foot gear to claim 29, wherein said upper portion is foldable about said wearer's calf to expose said second decorative pattern of said inner lining in overlying relationship with respect to said first decorative pattern thereby creating a complementing decorative appearance which comprises said first and second decorative patterns.

* * * * *